US005542839A

United States Patent [19]

Kelly

[11] Patent Number: 5,542,839

[45] Date of Patent: Aug. 6, 1996

[54] TEMPERATURE CONTROLLED LOW EMISSIONS BURNER

[75] Inventor: John T. Kelly, Los Gatos, Calif.

[73] Assignee: Gas Research Institute, Chicago, Ill.

[21] Appl. No.: 189,426

[22] Filed: Jan. 31, 1994

[51] Int. Cl.[6] ..... F23D 14/84

[52] U.S. Cl. ..... 431/10; 431/181; 431/187

[58] Field of Search ..... 431/8, 9, 10, 181, 431/187, 188, 284, 285

[56] References Cited

U.S. PATENT DOCUMENTS

| | | | |
|---|---|---|---|
| 3,163,203 | 12/1964 | Ihlenfield | 158/11 |
| 4,098,255 | 7/1978 | Nowak | 126/91 |
| 4,171,199 | 10/1979 | Henriques | 431/351 |
| 4,181,491 | 1/1980 | Hovis | 431/187 |
| 4,351,632 | 9/1982 | Nagai | 431/183 |
| 4,445,843 | 5/1984 | Nutcher | 431/115 |
| 4,604,048 | 8/1986 | Schwartz et al. | 431/188 X |
| 4,610,625 | 9/1986 | Bunn | 431/284 |
| 4,626,195 | 12/1986 | Sato et al. | 431/188 |
| 4,679,512 | 7/1987 | Skoog | 110/347 |
| 4,797,087 | 1/1989 | Gitman | 431/10 |
| 4,807,541 | 2/1989 | Masai | 110/262 |
| 4,815,966 | 3/1989 | Janssen | 431/285 X |
| 5,147,199 | 9/1992 | Perthuis et al. | 431/10 |
| 5,347,937 | 9/1994 | Vatsky | 431/188 X |

FOREIGN PATENT DOCUMENTS

| | | |
|---|---|---|
| 3518080 | 11/1986 | Germany . |
| 3206074 | 7/1988 | Germany . |
| WO85/00051 | 1/1985 | WIPO . |

*Primary Examiner*—Carl D. Price
*Attorney, Agent, or Firm*—Dick and Harris

[57] ABSTRACT

An industrial process burner which operates with optimal control of fuel/air mixing and reduced $NO_x$ emissions. The burner has a body formed with a primary fuel jet which is surrounded by inner and outer sets of air jets. The inner set of air jets directs air for mixing with the primary fuel jet. The outer set of air jets directs air which entrains a portion of combustion products for diluting the pre-combustion air/fuel mixture to lower the flame temperature and reduce $NO_x$ emissions. A secondary set of fuel jets directs fuel along a path apart from the primary fuel jet, and a set of additional air jets merges into and deflects air flow from the secondary jets inwardly to the base of the primary fuel jet for establishing a local combustion zone to promote ignition of the flame.

21 Claims, 5 Drawing Sheets

TEMPERATURE CONTROLLED LOW EMISSIONS BURNER

BACKGROUND OF THE INVENTION

1. Field of the Invention

This invention relates to burners for use in high temperature industrial processes, such as steel reheating, aluminum melting, glass melting, mineral processing and the like.

2. Description of the Related Art

Conventional high temperature industrial process, such as steel reheating, have furnace exhaust gas temperatures in excess of 2000° F. Because these high exhaust temperatures result in decreased energy efficiency and increased fuel costs, recuperative and regenerative heat exchangers have been employed to recover the exhaust heat by preheating the combustion air. While high-performance burners of this type have the potential to increase fuel efficiency, they produce high peak gas temperatures which lead to high $NO_x$ emissions. This limits application of the burners in areas where air quality and $No_x$ emission regulations are enforced.

Heretofore, high air temperature preheat burners have been developed which employ certain $NO_x$ control techniques. A principal technique is to suppress peak flame temperatures by dilution of the combustion reactants with inert gases, such as through the use of external flue gas recirculation, and/or by heat transfer from the flame zone, such as through enhanced flame emissivity.

Low $NO_x$ burners for high air temperature preheat applications have been developed through minor modifications to existing burners, and these modified burners produce moderate $NO_x$ reductions. More aggressive designs have drastically lowered flame temperatures from the levels expected at high furnace and air preheat temperatures, but these designs compromise flame stability during furnace heat-up, when furnace and air preheat temperatures are low. To overcome these problems, burners have been employed which use mechanical valves to alter hot flue gas or air flows, or have even used supplemental burners to heat up the furnace. However, these approaches are costly and unreliable.

Among the prior burners employing aggressive $NO_x$ reduction designs for lowering $NO_x$ are those in which the number of air ports is reduced, the distance between the fuel jet and air jets is increased and the quarl depth is reduced. While in such designs $NO_x$ has been lowered to below 150 ppm at up to 750° F. preheat, the disadvantages are that flame momentum and chamber recirculation are reduced, and there are significant gas temperature non-uniformities.

Another prior art aggressive burner design for reducing $NO_x$ is that in which secondary air is injected around the fuel jet, and a valve is used to control the air flows to the annular and outer air jets. Although in such a design the gas temperature non-uniformities can be controlled, the flame character improved and $NO_x$ emissions lowered, the complexity, unreliability and cost of controlling air injection makes this burner design undesirable.

Another prior burner design using an aggressive approach to $NO_x$ reduction is that in which a fixed air jet burner has its fuel injector recessed into the refractory quarl for purposes of inducing furnace gas recirculation to the fuel jet. In such a design $NO_x$ levels are below 150 ppm at up to 750° F. preheat while maintaining a compact design and adequate flame momentum.

In yet another prior low-$NO_x$ burner design for air preheats up to 1200° F., a conventional fuel injector and inner set of air ports are surrounded by outer, tertiary air ports formed in the refractory quarl. Air flow into the tertiary ports is controlled by mechanical valves. This increases the complexity and cost of the burner design. In operation of such a burner, $NO_x$ is approximately 150 ppm at 750° F. air preheat, rising to approximately 200 ppm at 1200° F. air preheat.

The industry has sought a burner design which will reduce $NO_x$ to very low levels at air preheats up to the highest level allowed by recuperator or regenerative heat exchangers. In addition to $NO_x$ emission control effectiveness, it is desirable that the burner maintain optimum heat transfer, and that combustion (i.e. low CO and unburned hydrocarbon emission levels) and stability characteristics be consistent with those achieved by high-performance burners. In addition, it is desirable that the burner design operate with acceptable costs, reliability and turn-down capability. The ability to retrofit the burner into existing combustion chambers is also desirable.

OBJECTS AND SUMMARY OF THE INVENTION

It is a general object of the invention to provide a new and improved low-$NO_x$, high-performance burner for use in industrial processes with high air preheat temperature.

Another object is to provide a burner of the type described, which controls $NO_x$ emissions while maintaining desirable heat transfer, combustion and flame stability characteristics.

Another object is to provide a burner of the type described which is capable of reducing $NO_x$ emissions to very low levels at high air preheat temperatures.

Another object is to provide a burner of the type described which is adapted for retrofit into existing combustion chambers.

Another object is to provide a burner of the type described for use with furnaces of either recuperative or regenerative type systems.

The invention in summary provides a burner and method of operation in which a primary fuel flow is injected into a combustion chamber through a fuel jet in a burner body surrounded by air flow from inner air jets for combustion into a flame. A second air flow from outer air jets entrains a portion of combustion products within the chamber for lowering the flame temperature and reducing $NO_x$ emissions. A secondary fuel flow is injected along a path adjacent the first fuel flow, and a third air flow is directed along a path which converges on and deflects the secondary fuel flow inwardly into the base of the primary fuel jet for establishing a local combustion zone which promotes ignition of the flame.

The foregoing and additional objects and features of the invention will appear from the following specification in which the several embodiments have been set forth in detail in conjunction with the accompanying drawings.

DESCRIPTION OF THE PREFERRED EMBODIMENTS

Figure 1:
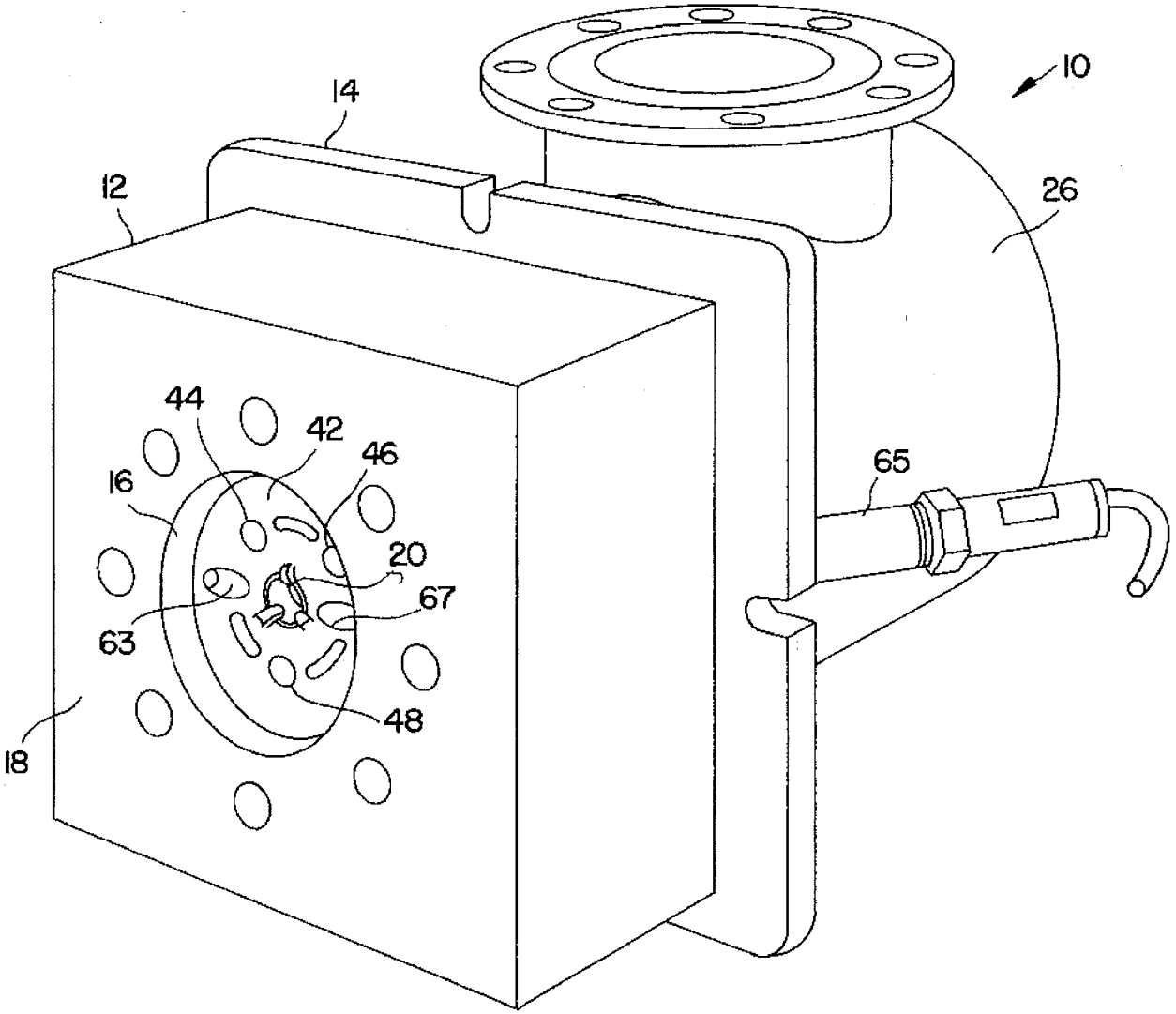
FIG. 1 is a perspective view illustrating a burner in accordance with one preferred embodiment of the invention.
Figure 3:
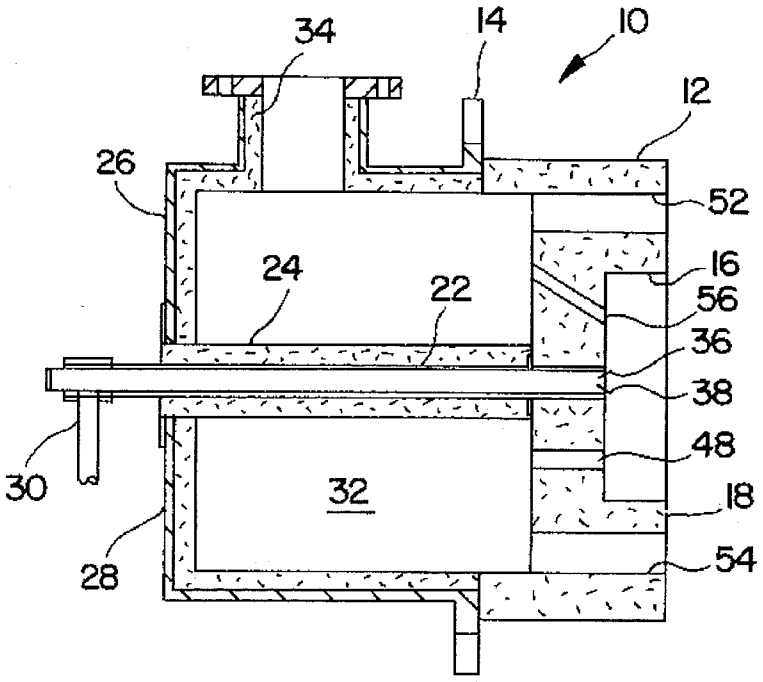
FIG. 3 is an axial cross section view taken along the line 3—3 of FIG. 2.
Figure 2:
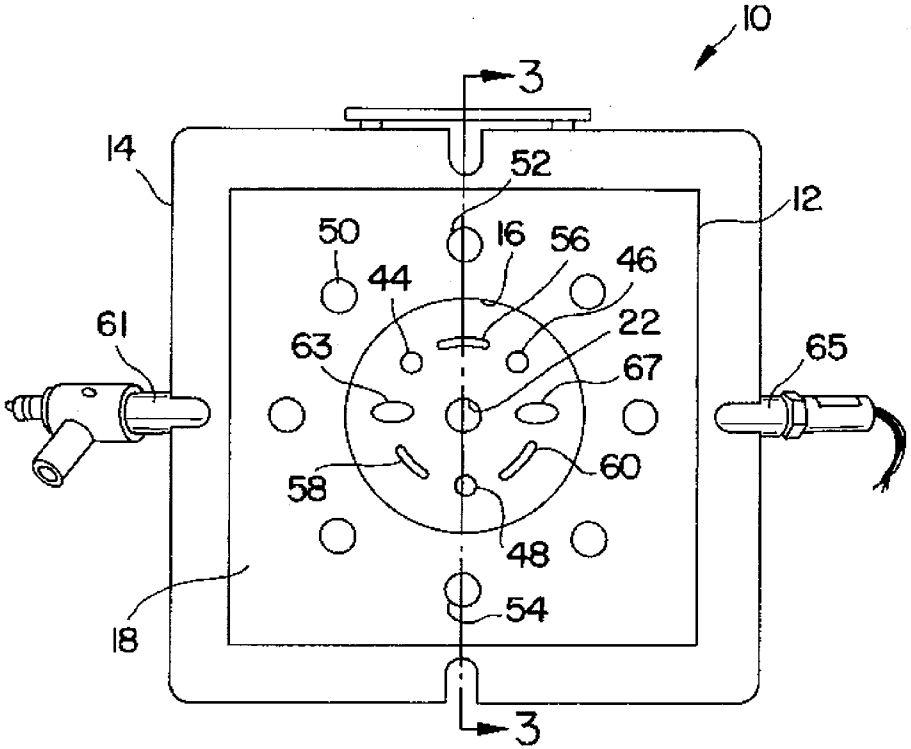
FIG. 2 is a front elevational view to a reduced scale of the burner shown in FIG. 1.

In the drawings FIGS. 1–4 illustrate generally at 10 a burner incorporating one preferred embodiment of the invention. Burner 10 is comprised of burner faceplate 12 carried on a flange 14 which is adapted for mounting in an opening in the combustion chamber, not shown, of the furnace or other combustion apparatus. A circular quarl or recess 16 is formed in the faceplate 18 centered on the burner's longitudinal axis.

Centered in recess 16 is a primary fuel jet opening 20 through which the outlet end of a fuel supply tube 22 is mounted. The midspan of the fuel supply tube is surrounded by a heat insulation layer 24, and the tube extends through the center of a cylindrical air manifold 26. The upstream end of the fuel supply tube penetrates through an opening formed in a circular plate 28 which forms the outer end of the air manifold. An inlet tube 30 is connected between the upstream end of the fuel supply tube and a source of pressurized fuel, such as natural gas. The volume within manifold 26 forms an air inlet plenum 32 which connects through opening 34 with a source of preheated air, not shown. The preheated air is supplied into the plenum under pressure from a suitable blower, not shown.

Figure 4:
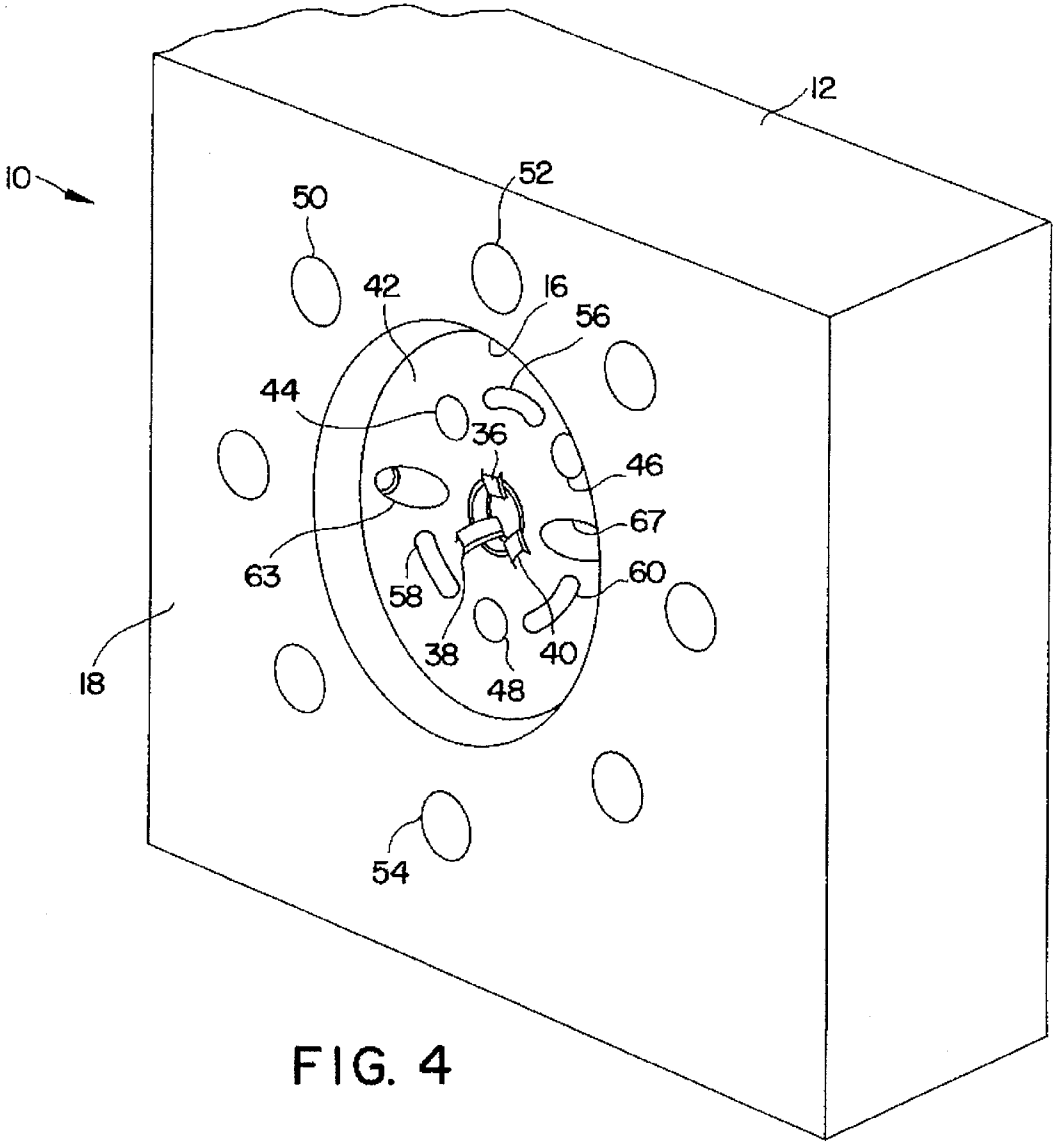
FIG. 4 is a perspective view, to an enlarged scale, of the burner faceplate of FIGS. 1–3.

Central opening 20 in recess 16 provides the primary fuel jet which is directed along the burner's longitudinal axis to produce a long flame extending into the combustion chamber. Secondary fuel jet means is provided for directing a secondary fuel flow along another path apart from that of the first fuel flow. In this embodiment the secondary fuel jet means comprises a plurality, shown as three, of deflectors 36, 38 and 40, as best shown in FIG. 4. The deflectors divide the primary fuel flow into a main portion and three secondary portions. Each deflector comprises a vane which is secured as by welding to the fuel supply tube 22 with the vane oriented at an angle across the burner's longitudinal axis. The angled vanes direct the three secondary portions of the fuel flow at diverging angles outwardly from the fuel jet opening.

Inner air jet means is provided for directing a first air flow into the combustion chamber for mixing with the primary fuel flow. The inner air jet means in this embodiment is comprised of three openings 44, 46 and 48 which extend through recess surface 42 and communicate with the air inlet plenum. These openings are positioned in circumferentially spaced relationship about an inner circle having a predetermined radius centered on the primary fuel jet. Air flowing through these openings forms a first air flow into the outer portion of the primary fuel flow to supply a portion of the oxygen for combusting fuel. The air is directed from openings 44–48 in axial directions surrounding the primary fuel jet to stabilize the flame. The first air flow from these openings also entrains a small portion of the combustion products, i.e. the furnace gases from within the combustion chamber.

Outer air jet means is provided for directing a second air flow into the combustion chamber and about the flame for entraining a substantially larger portion of the combustion products. The outer air jet means comprises a plurality, shown as eight, of openings 50, 52 and 54 formed through faceplate 18 in communication with plenum 32. Air directed from these openings entrains combustion products for mixing with pre-combustion fuel and air in the chamber. This serves to dilute the reactants in the flame with the inert gases of the combustion products and lower the flame temperature to thereby reduce $NO_x$ emissions. The outer rim of air jets also serve to expand and spread the flame zone volume and area to further reduce the flame zone temperature.

Additional air jet means is provided for directing a third air flow along a path which merges into and deflects the secondary fuel flow inwardly into the base of the primary fuel jet where slow moving and strongly combusting local zones are established to promote ignition of the flame. In the illustrated embodiment the additional air jet means comprises a plurality, shown as three, of inwardly inclined air jets 56, 58 and 60 which are formed by openings which penetrate through recess 42 and communicate with the air inlet plenum. The openings are circumferentially spaced about a circle centered on the burner's longitudinal axis. The axis of each opening is aligned with respective deflector vanes 36–40 so that the additional air jetting from each opening impinges and deflects inwardly upon the secondary flow of fuel moving along the diverging paths from that deflector vanes. The third air flow also entrains a small portion of the combustion products.

The three inwardly directed streams of the additional air and secondary fuel merge together at the base of the central fuel jet where they combust to promote flame ignition and essentially pilot the flame. The additional air and secondary fuel burn with only limited furnace gas entrainment prior to combustion and produce a small hot flame which is then used to ignite the larger and cooler flame from the primary fuel jet where substantial furnace gas entrainment is promoted.

A pilot tube 61 is mounted through the burner body and emerges at an opening 63 for igniting the fuel/air mixture. On the opposite side a conventional flame detector 65 is mounted which utilizes a UV radiation detector which is optically aligned with opening 67 for sensing the presence or absence of a flame.

Figure 6:
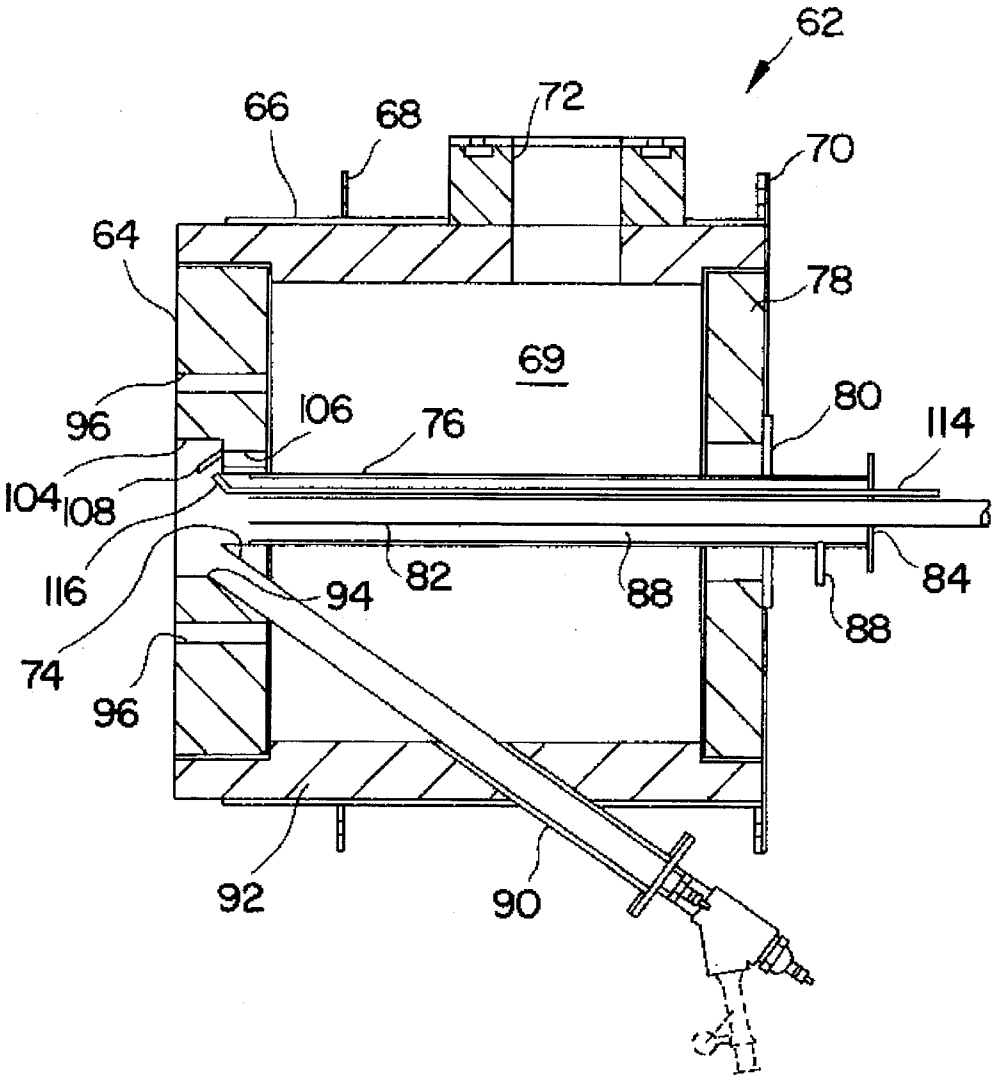
FIG. 6 is an axial section view taken along the line 5—5 of FIG. 4.
Figure 5:
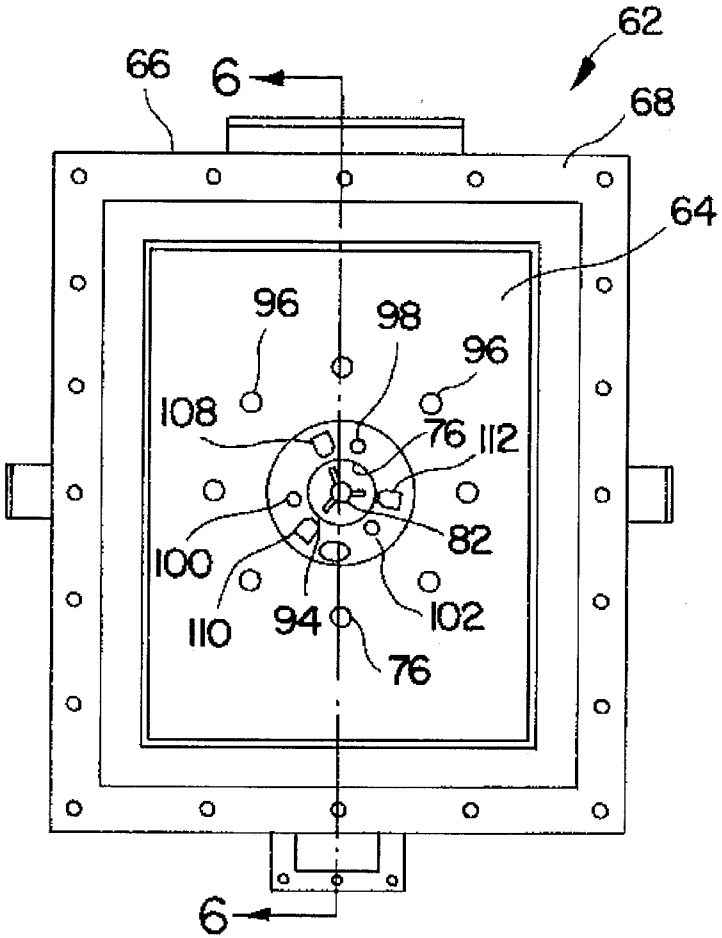
FIG. 5 is a front elevational view of a burner according to another embodiment of the invention.

FIGS. 5 and 6 illustrate another embodiment providing a burner 62 having a modified configuration. Burner 62 is comprised of a refractory faceplate 64 mounted at one end of a housing 66 which provides an inlet air plenum 69. Flanges 68 and 70 are provided on the housing for mounting the burner to the wall of a combustion chamber, not shown. An inlet port 72 in one side of the plenum housing is adapted for connection with a source of preheated air, also not shown.

Centered in the faceplate is an opening 74 which mounts the outlet end of an inner air jet tube 76. The midspan of tube 76 extends through an opening in rear plate 78 of the housing to which it is mounted by bracket 80. Mounted concentric within the air jet tube is a primary fuel jet tube 82, the inlet end of which is mounted on and extends through an opening in a plate 84 which closes off the inlet end of the air jet tube. An air supply line 88 directs pressurized air from a suitable source, not shown, into the annulus between the air jet tube and primary fuel jet tube. The air flow from the inner air jet tube entrains a small portion of the combustion products from within the combustion chamber.

A pilot tube 90 is mounted at an inwardly inclined angle through an opening in a sidewall 92 of the plenum housing. The outlet end of the pilot tube emerges through an opening 94 in faceplate 64 adjacent the outlet ends of the inner air jet tube and primary fuel jet tube. The pilot tube is operated in a conventional manner for igniting the fuel-air mixture into a long flame which extends axially from the burner into the combustion chamber.

Outer air jet means is provided for directing a secondary air flow into the combustion chamber for entraining a substantially larger portion of the combustion products into the pre-combustion fuel/air mixture for lowering the flame temperature and reducing $NO_x$ emissions. This means comprises a plurality, shown as eight, of air jet openings 96 formed through the faceplate in circumferentially spaced-apart relationship concentric with the primary fuel jet. Preheated air from plenum 69 jets out through these openings along paths parallelling the primary fuel jet.

Additional combustion air is provided by means of three inner air jets 98, 100 and 102 which are formed in the base of a recess 104 in the faceplate. The inner air jets are circumferentially spaced apart and extend coaxial with fuel jet tube 82 so that preheated air is directed out parallel with the primary fuel jet into the flame.

Additional air jet means is provided and comprises a plurality, shown as three, of air jets 106 which are formed through the base of the faceplate recess 104 in circumferentially spaced-apart relationship coaxial with the primary fuel jet tube. Deflector vanes 108, 110 and 112 are mounted on the outer edge of the outlet ends of the respective additional air jets. The deflector vanes redirect the flows of air exiting the air jets along inwardly inclined paths toward the base of the primary fuel jet. These additional air jets also entrain a small portion of the combustion products.

Secondary fuel jet means is provided for directing a secondary fuel flow for merging with the air flow from the additional air jets. The secondary fuel jet means comprises a plurality, which can be equal in number to the number of additional air jets, of fuel injection tubes 114. As best shown in FIG. 6, the typical injection tube 114 projects through plate 84 and extends along the annulus 88 between the inner air jet tube and primary fuel jet tube. The outlet ends of the injection tubes are formed with bights 116 which extend outwardly at inclined angles into alignment with respective ones of the deflector vanes. The source of fuel, not shown, directs fuel under pressure through the injection tubes and through their outlet ends along paths which merge with the additional air jets. The additional air jets merge with and deflect the secondary fuel flow inwardly to the base of the primary fuel jet. These air jets also entrain a small portion of the combustion products. The converging fuel/air flows establish local combustion zones at the base of the primary fuel jet to promote ignition of the flame. This serves to enhance flame stability, particularly during heat-up. The amount of fuel directed through the secondary fuel jets can be a small fraction of the total fuel.

The use and method of operation of the invention will be explained in connection with the embodiment of FIGS. 5 and 6. A source of natural gas, not shown, is provided for supplying fuel into primary fuel jet tube 82 and the three injection fuel jet tubes 114. Preheated air, which can be at a temperature in the range of 775° F. to 1540° F., is directed under pressure into plenum 69. With the fuel jetting out into the combustion chamber from the primary and injection tubes, pilot 90 is operated to ignite the flame. During heat-up, both furnace gas and air preheat temperatures are relatively low such that excess air levels are required to maintain flame temperatures at a level sufficient to stabilize the flame. With the burner operating at 500,000 Btu/hr load and 10% excess air, the flame length is approximately six feet. The air flow from the outer air jets entrain combustion products from within the chamber so that the combustion products mix into and dilute the fuel and air mixture. This reduces peak flame temperatures and thereby reduces $NO_x$ emissions. The outer air jets also expand and spread the flame zone volume and area to further reduce the flame zone temperature.

The secondary jets from injection tubes 114 are directed outwardly to merge with the paths of the air flow from additional air jets 106, and this air flow is deflected inwardly by vanes 108. The merged flow of secondary fuel and additional air is directed inwardly toward the base of the primary fuel jet to establish local combustion zones which promote ignition of the flame. The secondary fuel and initial air intermix and burn with only limited furnace gas entrainment to produce a small hot flame which then ignites the larger and cooler flame derived from primary fuel jet 82, where substantial furnace gas entrainment is promoted.

Figure 7:
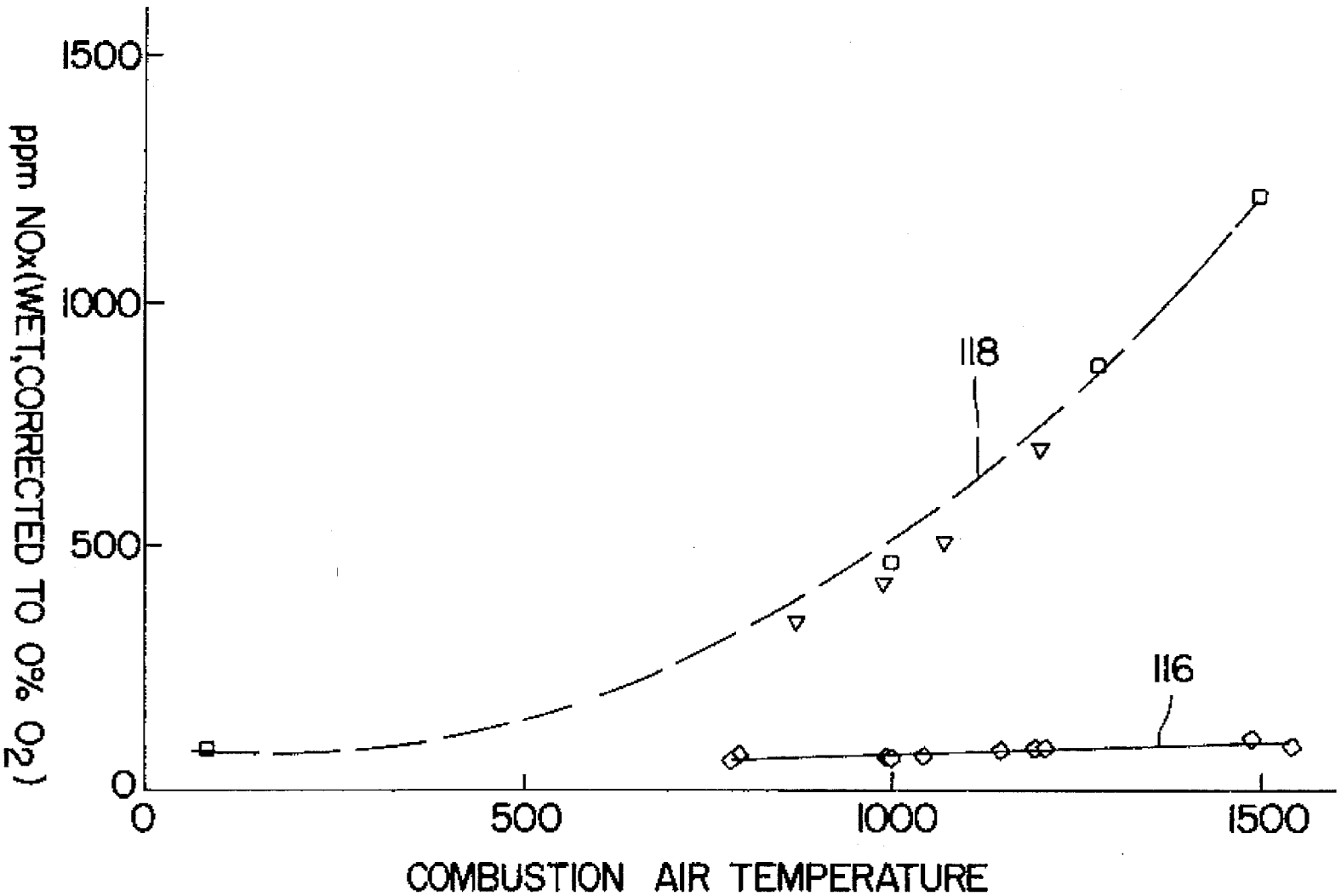
FIG. 7 is a graph illustrating the operating results of the burner shown in FIGS. 4 and 5.

The test results from the operation of a burner made in accordance with the embodiment of FIGS. 5 and 6 are illustrated in the chart of FIG. 7. This chart plots $NO_x$ emissions as a function of combustion air temperature while operating at 500,000 Btu/hr furnace load and with the data corrected to 2400° exit gas temperature. On the chart line, 116 represents the performance of results from the burner of FIGS. 5 and 6 while line 118 represents the performance trend of conventional burner operation. Commercial GTE and North American burner results, as well as other conventional test burner results, follow the conventional burner trend line in FIG. 7. For a given oxygen level, and for conventional burners, the line 118 demonstrates that $NO_x$ increases with preheat temperature. With a 2% oxygen normal operating condition and a maximum preheat of 1500° F., the line 116 shows that with the burner of the present invention the $NO_x$ emissions are approximately 100 ppm. Compared to the conventional burner performance shown by line 118, the burner of FIGS. 4 and 5 reduces $NO_x$ emissions by over 90%, which is a very substantial reduction. In addition to reducing $NO_x$ the burner of the present invention also has good stability, both during heat-up and normal operation. The burner of the invention also maintains desirable heat transfer characteristics and turn-down capability. The burner is also readily adaptable for retrofit into existing combustion chambers. Furthermore, under normal operating conditions, the CO and unburned hydrocarbon emissions are below 60 ppm and 30 ppm, respectively. Flame lengths from the burner are compatible with the volumes of conventional furnaces, and burner fuel and air pressure requirements are relatively low.

While the foregoing embodiments are at present considered to be preferred it is understood that numerous variations and modifications may be made therein by those skilled in the art and it is intended to cover in the appended claims all such variations and modifications as fall within the true spirit and scope of the invention.

What is claimed is:

1. A burner for use in industrial processes to combust fuel and air in a combustion chamber with optimal control of fuel/air mixing and reduced $NO_x$ emissions, the burner comprising:

a burner body adapted for mounting into the combustion chamber;

primary fuel jet means disposed in the burner body for directing a primary fuel jet from the burner body in a primary fuel path along a longitudinal axis into the combustion chamber for combustion into a flame to produce heat and combustion products, the primary fuel jet having a base substantially adjacent the burner body, the primary fuel jet extending therefrom into the combustion chamber;

inner air jet means disposed in the burner body at a first distance from the longitudinal axis for directing one or more first air flows for mixing with the primary fuel jet;

outer air jet means disposed in the burner body at a second distance from the longitudinal axis for directing a plurality of secondary air flows into the combustion chamber at positions disposed substantially circumferentially about the primary fuel jet for entraining a first portion of the combustion products from within the chamber for mixing said entrained combustion products with fuel from the primary fuel jet and air from the inner air jet means, prior to combustion of same, for lowering the flame temperature and reducing $NO_x$ emissions;

secondary fuel jet means disposed in the burner body for directing a secondary fuel flow along a secondary fuel path which is divergent relative to said longitudinal axis; and additional air jet means disposed in the burner body for directing a third air flow along a merging path which deflects said secondary fuel flow into the base of the primary fuel jet for establishing a local combustion zone to promote ignition of the primary fuel jet into flame.

2. The burner according to claim 1 in which said inner air jet means is configured to direct said first air flow along an inner path positioned substantially parallel with said longitudinal axis and substantially circumferentially about the primary fuel jet.

3. The burner according to claim 1 in which said outer air jet means directs said second air flow along an outer path positioned substantially parallel with said first air flow and radially spaced outwardly therefrom.

4. The burner according to claim 1 in which said additional air jet means comprises:

means disposed in the burner body for directing the third air flow for a first distance along a direction substantially parallel with the primary fuel jet, and means disposed in the burner body for deflecting air from the third air flow along an inwardly inclined path.

5. The burner according to claim 4 in which said additional air jet means comprises:

a plurality of air jets disposed in the burner body and arrayed in circumferentially spaced relationship about the outer air jet means.

6. The burner according to claim 1 in which said secondary fuel jet means comprises:

a plurality of fuel jets disposed in the burner body and arrayed in circumferentially spaced-apart relationship about said primary fuel jet.

7. The burner claim 1 in which said inner air jet means are disposed within the burner body so as to entrain a second portion of said combustion products which second portion is smaller than said first portion of combustion products.

8. The burner according to claim 1 in which said additional air jet means are disposed in said burner body so as to entrain a second portion of said combustion products which second portion is smaller than said first portion of combustion products.

9. A burner for use in industrial processes to combust fuel and air in a combustion chamber with optimal control of fuel/air mixing and reduced $NO_x$ emissions, the burner comprising:

a burner body adapted for mounting into the combustion chamber;

primary fuel jet means disposed in the burner body for directing a primary fuel jet from the burner body in a primary fuel path along a longitudinal axis into the combustion chamber for combustion into a flame to produce heat and combustion products, the primary fuel jet having a base substantially adjacent the burner body, the primary fuel jet extending therefrom into the combustion chamber;

inner air jet means disposed in the burner body at a first distance from the longitudinal axis for directing one or more first air flows for mixing with the primary fuel jet;

outer air jet means disposed in the burner body at a second distance from the longitudinal axis for directing a plurality of secondary air flows into the combustion chamber at positions disposed substantially circumferentially about the primary fuel jet for entraining a first portion of the combustion products from within the chamber for mixing said entrained combustion products with fuel from the primary fuel jet and air from the inner air jet means, prior to combustion of same, for lowering the flame temperature and reducing $NO_x$ emissions;

secondary fuel jet means disposed in the burner body for directing a secondary fuel flow along a secondary fuel path; and additional air jet means disposed in the burner body for directing a third air flow along a merging path which merges into said secondary fuel flow and into the base of the primary fuel jet for establishing a local combustion zone to promote ignition of the primary fuel jet into flame, said secondary fuel jet means including deflector means for dividing the primary fuel jet into a first portion and a second portion, said deflector means directing the second portion along an outwardly diverging path to form said secondary fuel flow while enabling the first portion of said primary fuel jet to continue along said longitudinal axis for combustion in said flame, said outwardly diverging path of the second portion crossing the path of said third air flow for causing said merging of the third air flow into the secondary fuel flow.

10. The burner according to claim 9 in which said deflector means comprises:

vane means carried by the burner and positioned in the path of said primary fuel jet.

11. A burner for use in industrial processes to combust fuel and air in a combustion chamber with optimal control of fuel/air mixing and reduced $NO_x$ emissions, the burner comprising:

a burner body adapted for mounting into the combustion chamber;

primary fuel jet means disposed in the burner body for directing a primary fuel jet from the burner body in a primary fuel path along a longitudinal axis into the combustion chamber for combustion into a flame to produce heat and combustion products, the primary fuel jet having a base substantially adjacent the burner body, the primary fuel jet extending therefrom into the combustion chamber;

inner air jet means disposed in the burner body at a first distance from the longitudinal axis for directing one or more first air flows for mixing with the primary fuel jet;

outer air jet means disposed in the burner body at a second distance from the longitudinal axis for directing a plurality of secondary air flows into the combustion chamber at positions disposed substantially circumferentially about the primary fuel jet for entraining a first portion of the combustion products from within the chamber for mixing said entrained combustion products with fuel from the primary fuel jet and air from the inner air jet means, prior to combustion of same, for lowering the flame temperature and reducing $NO_x$ emissions;

secondary fuel jet means disposed in the burner body for directing a secondary fuel flow along a secondary fuel path; and additional air jet means disposed in the burner body for directing a third air flow along a merging path which merges into said secondary fuel flow and into the base of the primary fuel jet for establishing a local combustion zone to promote ignition of the primary fuel jet into flame, said inner air jet means being configured to direct said first air flow along an inner path positioned substantially parallel with said longitudinal axis and substantially circumferentially about the primary fuel jet, said inner air jet means further including a plurality of air jets arrayed in circumferentially spaced-apart relationship about said primary fuel jet, at a radius of said first distance.

12. A burner for use in industrial processes to combust fuel and air in a combustion chamber with optimal control of fuel/air mixing and reduced $NO_x$ emissions, the burner comprising:

a burner body adapted for mounting into the combustion chamber;

primary fuel jet means disposed in the burner body for directing a primary fuel jet from the burner body in a primary fuel path along a longitudinal axis into the combustion chamber for combustion into a flame to produce heat and combustion products, the primary fuel jet having a base substantially adjacent the burner body, the primary fuel jet extending therefrom into the combustion chamber;

inner air jet means disposed in the burner body at a first distance from the longitudinal axis for directing one or more first air flows for mixing with the primary fuel jet;

outer air jet means disposed in the burner body at a second distance from the longitudinal axis for directing a plurality of secondary air flows into the combustion chamber at positions disposed substantially circumferentially about the primary fuel jet for entraining a first portion of the combustion products from within the chamber for mixing said entrained combustion products with fuel from the primary fuel jet and air from the inner air jet means, prior to combustion of same, for lowering the flame temperature and reducing $NO_x$ emissions;

secondary fuel jet means disposed in the burner body for directing a secondary fuel flow along a secondary fuel path; and additional air jet means disposed in the burner body for directing a third air flow along a merging path which merges into said secondary fuel flow and into the base of the primary fuel jet for establishing a local combustion zone to promote ignition of the primary fuel jet into flame, said outer air jet means directs said second air flow along an outer path positioned substantially parallel with said first air flow and radially spaced outwardly therefrom, said outer air jet means including a plurality of air jets arrayed in circumferentially spaced relationship about said primary fuel jet, at a radius of said second distance.

13. A burner for use in industrial processes to combust fuel and air in a combustion chamber with optimal control of fuel/air mixing and reduced $NO_x$ emissions, the burner comprising:

a burner body adapted for mounting into the combustion chamber;

primary fuel jet means disposed in the burner body for directing a primary fuel jet from the burner body in a primary fuel path along a longitudinal axis into the combustion chamber for combustion into a flame to produce heat and combustion products, the primary fuel jet having a base substantially adjacent the burner body, the primary fuel jet extending therefrom into the combustion chamber;

inner air jet means disposed in the burner body at a first distance from the longitudinal axis for directing one or more first air flows for mixing with the primary fuel jet;

outer air jet means disposed in the burner body at a second distance from the longitudinal axis for directing a plurality of secondary air flows into the combustion chamber at positions disposed substantially circumferentially about the primary fuel jet for entraining a first portion of the combustion products from within the chamber for mixing said entrained combustion products with fuel from the primary fuel jet and air from the inner air jet means, prior to combustion of same, for lowering the flame temperature and reducing $NO_x$ emissions;

secondary fuel jet means disposed in the burner body for directing a secondary fuel flow along a secondary fuel path; and additional air jet means disposed in the burner body for directing a third air flow along a merging path which merges into said secondary fuel flow and into base of the primary fuel jet for establishing a local combustion zone to promote ignition of the primary fuel jet into flame, said secondary fuel jet means including deflector means for directing the secondary fuel flow along an outwardly diverging path from the primary fuel jet so as to intersect with said merging path of the third air flow so that said third air flow deflects the secondary fuel flow inwardly.

14. The burner according to claim 13 in which said primary fuel jet means includes a fuel outlet orifice formed in the burner body; and said deflector means comprises:

vane means disposed adjacent said outlet orifice and positioned in the path of the primary fuel jet for dividing the primary fuel jet into a first portion and a second portion so as to deflect the second portion along said outwardly diverging path to form said secondary fuel flow while enabling the first portion of said primary fuel jet to continue along said longitudinal axis for combustion in said flame.

15. A method of combusting fuel and air in a combustion chamber for an industrial process with optimal control of fuel/air mixing and reduced $NO_x$ emissions, the method comprising the steps of:

directing a primary fuel jet, having a base and extending along a longitudinal axis, into the combustion chamber;

directing a first air flow along an inner path into the primary fuel jet;

combusting fuel in the primary fuel jet with air from the first air flow into a flame extending along a flame path within said chamber with the combusting fuel thereby producing combustion products;

directing a second air flow along an outer path substantially circumferentially about the flame path;

entraining a first portion of said combustion products into the second air flow;

mixing said entrained combustion products with pre-combustion fuel and air for lowering the flame temperature and reducing $NO_x$ emissions;

directing a secondary fuel flow into the combustion chamber along a path divergent from said longitudinal axis;

directing a third air flow into the secondary fuel flow to cause the third air flow to deflect at least a portion of the secondary fuel flow into the base; and combusting fuel in the secondary fuel flow in a combustion zone positioned at said base of the primary fuel jet for promoting ignition of the flame.

16. The method according to claim 15 further comprising the steps of:

diluting the primary fuel jet and secondary fuel flow with said entrained combustion products.

17. The method according to claim 15 further comprising the step of entraining with said first air flow a second portion of said combustion products which second portion is smaller than said first portion of combustion products.

18. The method according to claim 15 further comprising the step of entraining with said third air flow a second portion of said combustion products which second portion is smaller than said first-mentioned portion of combustion products.

19. A method of combusting fuel and air in a combustion chamber for an industrial process with optimal control of fuel/air mixing and reduced $NO_x$ emissions, the method comprising the steps of:

directing a primary fuel jet, having a base and extending along a longitudinal axis, into the combustion chamber;

directing a first air flow along an inner path into the primary fuel jet;

combusting fuel in the primary fuel jet with air from the first air flow into a flame extending along a flame path within said chamber with the combusting fuel thereby producing combustion products;

directing a second air flow along an outer path substantially circumferentially about the flame path;

entraining a first portion of said combustion products into the second air flow;

mixing said entrained combustion products with pre-combustion fuel and air for lowering the flame temperature and reducing $NO_x$ emissions;

directing a secondary fuel flow into the combustion chamber along a path divergent from said longitudinal axis;

directing a third air flow into the secondary fuel flow to cause the third air flow to merge into a portion of the secondary fuel flow into the base; and combusting fuel in the secondary fuel flow in a combustion zone positioned at said base of the primary fuel jet for promoting ignition of the flame, and further including dividing the primary fuel jet into a first portion and a second portion;

deflecting the second portion along an outwardly diverging path to form said secondary fuel flow, which crosses the path of the third air flow, while enabling the first portion of said primary fuel jet to continue along the longitudinal axis for combustion in said flame.

20. A method of combusting fuel and air in a combustion chamber for an industrial process with optimal control of fuel/air mixing and reduced $NO_x$ emissions, the method comprising the steps of:

directing a primary fuel jet, having a base and extending along a longitudinal axis, into the combustion chamber;

directing a first air flow along an inner path into the primary fuel jet;

combusting fuel in the primary fuel jet with air from the first air flow into a flame extending along a flame path within said chamber with the combusting fuel thereby producing combustion products;

directing a second air flow along an outer path substantially circumferentially about the flame path;

entraining a first portion of said combustion products into the second air flow;

mixing said entrained combustion products with pre-combustion fuel and air for lowering the flame temperature and reducing $NO_x$ emissions;

directing a secondary fuel flow into the combustion chamber along a path divergent from said longitudinal axis;

directing a third air flow into the secondary fuel flow to cause the third air flow to merge into a portion of the secondary fuel flow into the base; and combusting fuel in the secondary fuel flow in a combustion zone positioned at said base of the primary fuel jet for promoting ignition of the flame, and further including the steps of:

directing the secondary fuel flow along a path which diverges outwardly from the primary fuel jet;

causing the third air flow to merge into the outwardly diverging path of the secondary fuel flow; and deflecting the secondary fuel flow inwardly into said base of the primary fuel jet.

21. A method of combusting fuel and air in a combustion chamber for an industrial process with optimal control of fuel/air mixing and reduced $NO_x$ emissions, the method comprising the steps of:

directing a primary fuel jet, having a base and extending along a longitudinal axis, into the combustion chamber;

directing a first air flow along an inner path into the primary fuel jet;

combusting fuel in the primary fuel jet with air from the first air flow into a flame extending along a flame path within said chamber with the combusting fuel thereby producing combustion products;

directing a second air flow along an outer path substantially circumferentially about the flame path;

entraining a first portion of said combustion products into the second air flow;

mixing said entrained combustion products with pre-combustion fuel and air for lowering the flame temperature and reducing $NO_x$ emissions;

directing a secondary fuel flow into the combustion chamber along a path divergent from said longitudinal axis;

directing a third air flow into the secondary fuel flow to cause the third air flow to merge into a portion of the secondary fuel flow into the base; and combusting fuel in the secondary fuel flow in a combustion zone positioned at said base of the primary fuel jet for promoting ignition of the flame, the step of directing the third air flow into the secondary fuel flow further including the steps of:

directing the third air flow along a path which diverges inwardly into the outwardly diverging path of the secondary fuel flow.

* * * * *